US008916086B2

(12) United States Patent
Smit et al.

(10) Patent No.: US 8,916,086 B2
(45) Date of Patent: Dec. 23, 2014

(54) PROCESS FOR THE PRODUCTION OF FIBERS

(75) Inventors: Anton Eugene Smit, Boksburg (ZA); Ronald Douglas Sanderson, Western Cape (ZA)

(73) Assignee: Stellenbosch University, Stellenbosch, Western Cape (SO)

( * ) Notice: Subject to any disclaimer, the term of this patent is extended or adjusted under 35 U.S.C. 154(b) by 689 days.

(21) Appl. No.: 12/595,792

(22) PCT Filed: Apr. 17, 2008

(86) PCT No.: PCT/IB2008/000935

§ 371 (c)(1), (2), (4) Date: Mar. 22, 2010

(87) PCT Pub. No.: WO2008/125971

PCT Pub. Date: Oct. 23, 2008

(65) Prior Publication Data

US 2010/0207303 A1 Aug. 19, 2010

(30) Foreign Application Priority Data

Apr. 17, 2007 (ZA) ..... 2007/03137
Oct. 23, 2007 (ZA) ..... 2007/09111

(51) Int. Cl.
*D01F 1/10* (2006.01)
*D01D 5/00* (2006.01)

(52) U.S. Cl.
CPC ..... *D01D 5/0069* (2013.01); *D01D 5/0038* (2013.01)
USPC ..... 264/465; 264/211

(58) Field of Classification Search
USPC ..... 264/465, 484, 211
See application file for complete search history.

(56) References Cited

U.S. PATENT DOCUMENTS

| | | | | |
|---|---|---|---|---|
| 692,631 | A | 2/1902 | Cooley | |
| 1,975,504 | A | 10/1934 | Formhals | |
| 2,109,333 | A | 2/1938 | Formhals | |
| 4,842,505 | A * | 6/1989 | Annis et al. | 264/465 X |
| 2003/0213218 | A1 * | 11/2003 | Dubson | 264/465 X |
| 2004/0217010 | A1 | 11/2004 | Hu et al. | |
| 2009/0087469 | A1 * | 4/2009 | Zhang et al. | 264/484 X |
| 2009/0093585 | A1 * | 4/2009 | Smith et al. | 264/465 X |
| 2010/0001438 | A1 * | 1/2010 | Kishimoto | 264/465 |

FOREIGN PATENT DOCUMENTS

| | | | |
|---|---|---|---|
| DE | 689870 | | 4/1940 |
| EP | 1059106 | A2 | 12/2000 |
| JP | 2001505966 | | 5/2001 |
| JP | 3918179 | | 5/2007 |
| JP | 2007126766 | | 5/2007 |
| JP | 2007176940 | | 7/2007 |
| KR | 20090031759 | | 3/2009 |
| WO | WO 0022207 | A2 | 4/2000 |
| WO | WO 03004735 | A1 | 1/2003 |
| WO | WO 2004016839 | A1 | 2/2004 |

(Continued)

*Primary Examiner* — Leo B Tentoni
(74) *Attorney, Agent, or Firm* — Greer, Burns & Crain, Ltd.

(57) ABSTRACT

A process is provided for producing fibers which includes forming a plurality of bubbles on the surface of a fiber spinning solution, applying a voltage between the solution and a counter-electrode spaced apart therefrom to cause jets to extend from the bubbles to the counter-electrode, and treating the solution with a surfactant to stabilize the bubbles.

13 Claims, 5 Drawing Sheets

(56) References Cited

FOREIGN PATENT DOCUMENTS

| | | | |
|---|---|---|---|
| WO | WO 2004080681 | A1 | 9/2004 |
| WO | WO 2005073442 | A1 | 8/2005 |
| WO | WO 2005090653 | A1 | 9/2005 |
| WO | WO 2005100654 | A2 | 10/2005 |
| WO | WO 2006043968 | A2 | 4/2006 |
| WO | WO 2006047453 | A2 | 5/2006 |
| WO | WO 2008062264 | A2 | 5/2008 |

* cited by examiner

PROCESS FOR THE PRODUCTION OF FIBERS

FIELD OF THE INVENTION

This invention relates to the production of very fine fibres from various polymers, polymer blends, ceramic precursor mixtures and metal precursor mixtures.

BACKGROUND TO THE INVENTION

Very fine fibres from polymer solutions, often referred to as nanofibres, are useful in a wide variety of applications, including filter media, tissue-engineering scaffold structures and devices, fibre-reinforced composite materials, sensors, electrodes for batteries and fuel cells, catalyst support materials, wiping cloths, absorbent pads, post-operative adhesion preventative agents, smart-textiles as well as in artificial cashmere and artificial leather.

Electrostatic spinning of fibres was first described in U.S. Pat. No. 692,631. In principle, a droplet of polymer solution or melt is placed in a high electric field. The repulsion between the induced like-charges in the droplet compete with the surface tension of the liquid and when sufficiently strong electric field is applied (typically 0.5-4 kV/cm), the electrostatic forces overcome the surface tension of the fluid and a jet of polymer solution or melt is ejected from the droplet. Electrostatic instability leads to rapid, chaotic whipping of the jet, leading, in turn, to fast evaporation of the solvent as well as stretching and thinning of the polymer fibre that is left behind. The formed fibres are then collected on a counter electrode, typically in the form of a nonwoven web. The collected fibres are usually quite uniform and can have fibre diameters of several micrometers, down to as low as 5 nm.

The technical barriers to manufacturing large amounts of nanofibres through electrospinning include low production rates and the fact that most polymers are spun from solution. On average, solution based electrospinning, using needle spinnerets, have solution throughput rates on the order of 1 ml per hour per needle. Fibres with diameters in the range of 50 to 100 nm are typically spun from solutions with relatively low concentrations, 0.5-10 wt % depending on polymer type and molecular weight. This means that, assuming a polymer density of around 1 g/ml, the typical solids throughput rate of a needle-based electrospinning process is 0.005 g to 0.01 g of fibre per hour per needle. If one extends this calculation, producing a nanofibre web with a planar density of 80 g/m$^2$ at a rate of 5 m$^2$/s will require a minimum of 40 000 needles. In addition to the requirement for such large numbers of needles, electrical field interference between the different needles also limits the minimum separation between them and furthermore, continuous operation of needle-based spinnerets requires frequent cleaning of the needles as polymer deposits block the spinnerets.

Although the electrospinning process is relatively cost effective on a laboratory scale, the low rates of fibre throughput on single-needle setups make production at industrial volumes prohibitively expensive for most commodity applications like filtration and absorbent textiles. By increasing production rates, the cost can be dramatically lowered, broadening the scope of application for electrospun nanofibres and opening the door to the development of new technologies.

Formhals already tried to increase electrospinning production rates in 1934 (U.S. Pat. No. 1,975,504) by using multiple cogwheel sources. In later designs, he used multiple needle setups (U.S. Pat. No. 2,109,333) which have since become the first obvious approach to increase electrospinning production rates in the laboratory. The multiple needle approach might appear straightforward, but it is often inconvenient due to system complexity and the high probability of needle clogging.

In more recent times, different approaches have been proposed. Reneker et al. (PCT WO 00/22207) describe a process in which nanofibres were produced by feeding fibre-forming solution into an annular column, forcing a gas through the column in order to form an annular film which was then broken up into numerous strands of fibre-forming material.

Kim (PCT WO 2003/03004735) designed a complex multiple nozzle block system in which the spinning solution is controlled through gas flow.

Upward needleless electrospinning of multiple nanofibres proposed by A. L. Yarin, E. Zussman, Polymer 45 (2004) 2977-2980 uses a two-layer system, with the lower layer being a ferromagnetic suspension and the upper layer a polymer solution. When a permanent magnetic field was applied to the system, steady vertical spikes of the magnetic fluid pushed up through the interlayer interface and the free layer of the polymer solution. When a strong electric field was applied across the system in this state, multiple electrospinning jets initiated from the spike tips, leading to high rates of fibre production. When the jet packing density was compared to a multiple needle setup, a twelve fold enhancement in production was calculated. The needle-less process also avoids potential problems with clogging of needles. Potential drawbacks of the system include compatibility issues between the magnetic suspension and the polymer solution and the risk of contamination of the fibres from the fluid.

A special design for a melt-electrospinning multiple-needle nozzle pack was proposed by Chun and Park (PCT WO 2004/016839). However, except for the additional polymer melting components, the design did not differ significantly from previous multiple needle designs.

Karles et al. (PCT WO 2004/080681) describe various designs for higher throughput spinning and special counter-electrodes for the formed fibres but none of the multiple needle and spiked hairbrush-type spinning sources vary significantly from the needle and cogwheel sources already described by Formhals in the 1930s.

Improving on his 2003 design, Kim, together with Park, designed an upward spinning nozzle block with overflow-removing nozzle blocks and additional air-flow nozzles (PCT WO 2005/090653). In this design, the spinning nozzles consist of three concentric tubes. The inner tube supplies the spinning solution, the intermediate tube serves to remove excess non-spun solution when it overflows, and the outer tube creates a gas pocket around the spinning jet, reducing the effect of electrostatic repulsion that jets have on neighbouring jets. This design was incorporated into a subsequent patent describing the formation of continuous yarns from electrospun nanofibre webs (PCT WO 2005/073442).

Andrady et al. designed a system (PCT WO 2005/100654) consisting of a rotating tube through which the spinning solution is pumped to several jet outlets on the surface of the tube. The electrospun fibres are then collected on another rotating tube which is placed around the outside of the inner spinning tube. Despite this and additional complexity related to gas flows through the system, the spinning solution was pumped at a rate of approximately 1.5 ml/h, which is not much higher than the typical 1.0 ml/h flow rate used with a single-jet setup. Although the system is claimed to be for high throughput electrospinning, it rather embodies a special case of the laboratory-scale rotating drum method of fibre collection.

Andrady and Ensor subsequently designed another process, in which the polymer solution is pumped into a single, box-like container with 2 to 100 needle-like exits on the one side (PCT WO 2006/043968). This design is very similar to that used by NanoStatics (www.nanostatics.com). In both cases, high throughput of fibres is achieved, but the large dead volume of fluid behind the needles results in poor control of the flow rates at each needle. This in turn can lead to droplets and sputtered polymer fragments in the final fibre web.

A recent design by Beetz et al. (PCT WO 2006/047453) consists of a combination of high-pressure atomization and simultaneous electrospraying or electrospinning of a fluid. In essence, the spinning fluid is forced, under high pressure, through a small-diameter (<1 mm) tube, whilst applying a high voltage to the fluid.

Multiple jets on a porous tubular surface by Dosunmu et al., Nanotechnology 17 (2006) 1123-1127 describes the use of a polymer solution which was electrified and pushed by air pressure through the walls of a porous polyethylene tube. Multiple jets formed on the porous surface and electrospun into nanofibres. The production rate from the tube was approximately 250 times faster than a typical single jet. Further work still needs to be performed, but initial calculations indicate potential production rates the order of 4.2 g/min per meter length of porous tube. Although this method shows a lot of promise, some restrictions are placed on the spinnability of certain polymers by solution parameters like viscosity and conductivity.

The most significant high throughput electrospinning system at present is known as NanoSpider (http://www.nanospider.cz/). In this process, the fibre forming polymer solution is placed in a dish and a conductive cylinder is slowly rotated through the spinning solution, forming a thin layer of solution on the surface of the cylinder. When a sufficiently high voltage is applied between the spin-cylinder and the counter-electrode placed 10-20 cm above the cylinder, hundreds of jets initiate off the surface of the cylinder and electrospin onto the target. The laboratory-scale configuration of NanoSpider, depending on the polymer, has a productivity of about 1 g/min.

Japanese patent JP3918179 describes a process in which bubbles are continuously generated on the surface of a polymer solution by blowing compressed air into the solution through a porous membrane, or through a thin tube. High voltage is applied between the polymer solution and a counter-electrode plate. When the voltage is high enough, electrospinning jets are formed on the bubbles in the polymer solution and the fibres that form are collected on the counter-electrode. This disclosed process requires that the bubbles in the polymer solution be formed in high volumes and that they subsequently burst very rapidly. Although it is stated that any dissolvable polymer can be used, and any suitable solvent including various organic solvents, it is well known that most organic solvents do not readily form foams. The bubbles formed in such organic solutions will therefore be very short-lived. Additionally, although the patent claims general applicability to organic solutions, the given examples demonstrate spinning only with polymer solutions in water, 2-propanol and acetone. The patent also describes the requirement that the counter-electrode be placed at a suitable distance from the foam since droplets of spin solution that are created by the constantly bursting bubbles can spatter onto and destroy the already formed fibres on the counter-electrode.

OBJECT OF THE INVENTION

It is an object of this invention to provide a process for producing fibres which at least partially alleviates some of the abovementioned problems.

SUMMARY OF THE INVENTION

In accordance with this invention there is provided a process for producing fibres which includes forming a plurality of bubbles on the surface of a fibre spinning solution and applying a voltage between the solution and a counter-electrode spaced apart therefrom to cause jets to extend from the bubbles to the counter-electrode, and characterised in that the solution is treated to stabilise the bubbles.

Further features of the invention provide for the solution to be treated with a surfactant; for the surfactant to be selected from anionic surfactants, cationic surfactants, non-ionic surfactants, and zitterionic surfactants for aqueous solutions; and for the surfactant to include silicone surfactants for organic solutions.

Still further features of the invention provide for the rate of bubble formation in the solution to be controlled to maintain the bubbles at a predetermined distance from the counter-electrode; alternately for the bubbles to be formed in a container provided with an overflow through which bubbles exceeding a predetermined height are drawn off; and for the volume of the solution in the container to be maintained at a predetermined level.

Yet further features of the invention provide for the surfactant to enhance bubble lifetime and to improve bubble formation efficiency; and for the surfactant to further enhance bubble structure and uniformity.

Further features of the invention provide for fibres formed by the jets to be continuously drawn off the counter-electrode for further processing; and for the counter-electrode to include a plurality of spaced apart, moving conductors.

According to one aspect of the invention there is provided for the bubbles to be formed by introducing a gas under pressure into the solution.

Further features according to this aspect of the invention provide for the gas to be introduced into the solution at a pressure not substantially greater than that required to produce bubbles; and for the rate of introduction of the gas to be controlled to maintain the bubbles at predetermined distance from the counter-electrode.

BRIEF DESCRIPTION OF THE DRAWINGS

The invention will be described, by way of example only, with reference to the drawings in which.

DETAILED DESCRIPTION WITH REFERENCE TO THE DRAWINGS

Figure 1:
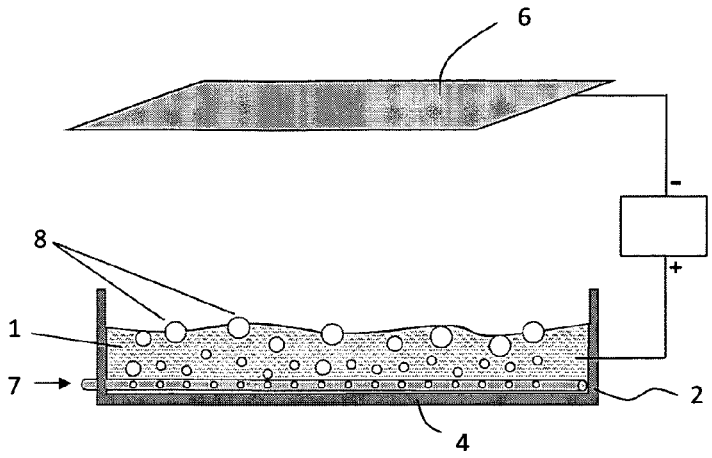
FIG. 1 is a diagrammatic illustration of apparatus for producing fibres.

The process of the invention includes forming bubbles on the surface of a fibre spinning solution and causing jets to erupt from the surface of the bubbles by applying a high voltage between the solution and a counter-electrode positioned above the surface of the bubbles spaced apart therefrom. The jets develop into fibres in known fashion as they travel to the counter-electrode. Importantly, the solution is treated with a suitable surfactant in order to stabilise the bubbles.

The action of surfactants in reducing surface tension and promoting bubble stability is well known. The choice of surfactant is to a large extent dependant on the characteristics of the solution and a wide variety of surfactants are available to choose from. The primary factor in selecting a surfactant though is its ability to extend the lifetime of the bubbles formed in the solution by stabilising them. It is thus preferred that the bubbles remain stable as long as possible and hence that the frequency of bubble wall ruptures is reduced as far as possible.

By extending bubble lifetimes through the addition of a foam-stabilising surfactants, more stable jets can form on each bubble surface, and turn into fibres, than when the bubbles are not stabilized. The increased bubble lifetime and associated jet stability also leads to the formation of more uniform fibres.

Also, every time that a bubble bursts, small droplets are generated through the rupture of the bubble wall. As also disclosed in the prior art, if these droplets fall on already-formed fibres, particularly on the web formed on the counter-electrode, they will re-dissolve and thereby destroy these fibres. Where the solution is not stabilised with a surfactant, bubble walls are frequently ruptured leading to formation of high volumes of such spattered droplets.

Addition of foam-stabilizing surfactants increases bubble lifetime and thereby lowers the frequency of bubble wall rupture. This implies a reduced volume of spattered droplets of polymer solution and enhanced quality in the fibres that are obtained.

Further factors considered when selecting a suitable surfactant include its ability to enhance bubble formation efficiency, bubble structure and bubble uniformity. Bubble structure is important as it has been found that, under similar conditions, more jets form on large bubbles than on small bubbles. In solutions that do not contain foam-stabilizing surfactants, the lifetimes of large bubbles are also shorter that those of small bubbles.

In general, anionic surfactants, cationic surfactants, non-ionic surfactants, and zitterionic surfactants can be used for aqueous solutions while silicone surfactants can be used for organic solutions. It may also be possible to use special nano-particles and polymers which have recently become available and which act like surfactants. In this specification the term "surfactant" shall have its widest meaning and include these products and any other agent which acts to stabilise bubbles. Where desired, any suitable mixture of surfactants can also be used.

Any suitable method of forming bubbles in the solution can be used including blowing a gas under pressure through the solution, agitating the solution, through expansion of a volatile liquid, such as pentane, in the solution, or through thermal decomposition of a granular substance, such as baking powder, in the solution. In most instances the most practical and easily controlled method of forming bubbles will be to blow a gas through the solution.

The use of a surfactant in such instances is further advantageous as high gas flow rates are required for bubble formation in non-stabilised solutions and this increases the amplitude of the bubble wall ruptures, posing an increased spatter risk to the already-formed fibres.

Adjusting the type of nozzle used and gas pressure it is also possible to form larger bubbles which have the advantage described above.

The pressure at which the gas is introduced into the solution will preferably not be substantially greater than that required to produce bubbles to further ensure bubble stability. Greater pressures result in faster bubbles formation and rupture.

When bubbles are blown in a polymer solution that does not contain a bubble-stabilising surfactant, bubbles are short-lived and new bubbles have to be generated constantly by blowing gas into the solution at high rates. In addition, when the bubbles are generated by blowing gas into the solution through a thin tube, the bubbles will primarily gather in a small area on the solution surface, right above the tube's opening. When bubbles are blown into such a solution through a porous membrane, bubbles will primarily form on the solution surface directly above the membrane and so the membrane area needs to be enlarged to efficiently form bubbles on the whole solution surface.

These disadvantages can be overcome through the use of a stabiliser. When the polymer solution does contain a suitable surfactant, the bubbles persist for longer after being formed. This means that the bubble forming gas that is blown into the solution is utilised more efficiently. This in turn implies that proportionately less will be used, which implies a cost saving on input materials, particularly if the gas is a specialty gas. Similarly, if the gas is compressed air, the proportionately smaller volumes used imply a cost saving on the energy required to generate the compressed air. In addition, the longer-lived bubbles in such a solution will tend to spread out to automatically cover large areas of the solution surface, which leads to better utilization of the available area for fibre formation. It also simplifies the manner in which the gas has to be introduced into the solution as it avoids the need for a large bubble producing surface.

In considering an appropriate surfactant and means of forming bubbles, the creation of a uniform bubble or foam surface on the solution should also be considered. The more uniform the surface the more consistent will be the fibres obtained. The apparatus with which the bubbles are formed should also provide means for controlling the distance of the surface of the bubbles or foam to the counter-electrode to a predetermined distance or range of distances. A simple way of doing this is to provide the container or bath holding the solution with an overflow through which excess bubbles are drawn off, allowed to disintegrate and then returned to the solution. This can easily be achieved by providing a trough about the circumference of a bath and spaced apart from the top thereof, with excess foam flowing over the top into the trough for recycling.

More complex apparatus may include the use of a device to measure the height of the foam in the bath and control of bubble formation, for example by controlling the rate at which gas is introduced into the solution, to so maintain the height of the foam at a predetermined level.

Any suitable counter-electrode can be used. The counter-electrode will preferably be configured to permit continuous removal of the fibres therefrom and could be of the type described in PCT/IB2007/003177 having a plurality of spaced apart, moving conductive strips. It is not necessary, however, that fibres collect directly on the counter-electrode.

The following examples serve to illustrate aspects of the invention described above.

Example 1

A solution with a concentration of 6 wt % was made of Polyacrylonitrile (PAN) (Mw=210 000 g/mol) in N,N-dimethylformamide (DMF). The foamability of the solution was tested by blowing compressed air at rates of between 150 and 3000 ml/min through the solution using a thin plastic tubular nozzle. The lifetimes of the individual bubbles that formed were far less than 1 second and stable bubbles could not be obtained. A silicone surfactant from an industrial source (JSYK 580 (L580)) was then added to the solution at a concentration of 244 g/l and the foamability tests were repeated. A stable foam that covered the entire surface of the bath could be generated and the lifetimes of individual bubbles ranged between 10 and 80 seconds.

Referring to FIG. 1, the fibre spinning solution (1) including the surfactant was poured into an elongate bath (2) with a surface area of 36 $cm^2$ and having a perforated tube (4) extending centrally across its length and fed with air from a standard air compressor (not shown). A counter-electrode (6) was positioned 13 cm above the bath.

Air (7) was then fed through the tube (4) and the flow rate regulated to obtain a stable foam (8) on the surface of the solution (1). A high voltage of 46 kV DC was then applied between the solution (1) and the counter-electrode (6).

Multiple electrospinning jets erupted from the surfaces of the bubbles forming the foam (8) and fibres were rapidly formed.

Figure 2A:
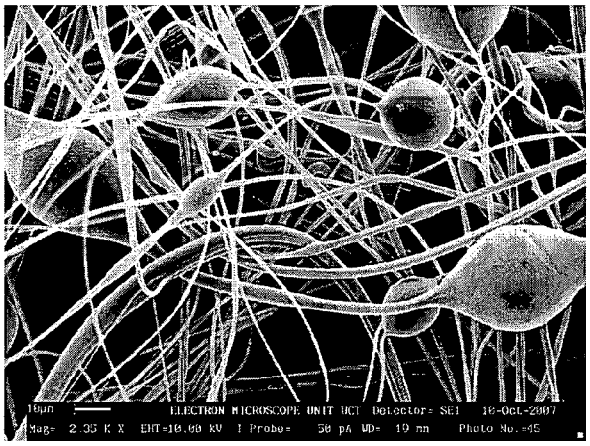
FIGS. 2*a* and 2*b* are scanning electron microscope (SEM) images of fibres formed using the apparatus in FIG. 1.
Figure 2B:
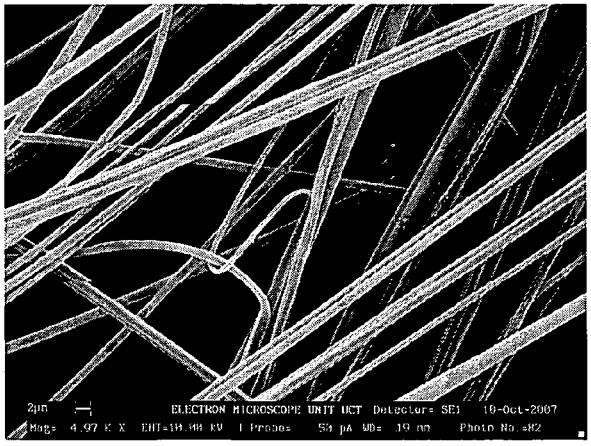
Figure 3:
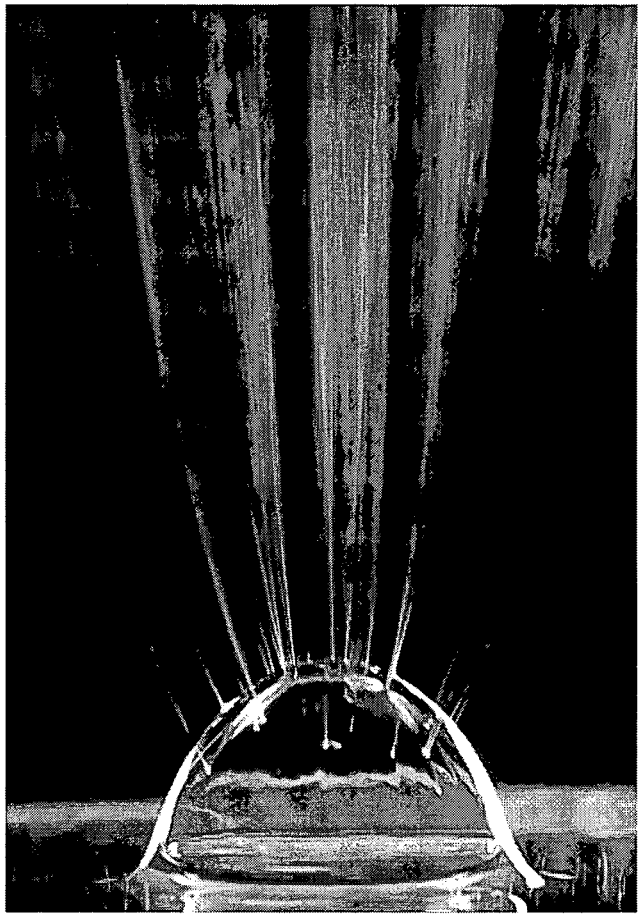
FIG. 3 is an image of electrospinning jets erupting from a bubble.

SEM analysis showed that the 6 wt % solution gave fibres with some beads and an average diameter of 1.18 μl m (see FIG. 2*a*). The process was repeated with an 8 wt % PAN solution with 244 g/l of the same silicone surfactant. SEM analysis showed that the formed fibres were more uniform, without beads, with an average fibre diameter of 1.29 μm (see FIG. 2*b*). FIG. 3 shows a single bubble formed under these conditions with multiple jets erupting from its surface.

Only insignificant amounts of fibres could be formed without the use a surfactant under the same conditions. These fibres primarily formed by field-induced electrospinning from sputtered droplets that formed as bubbles burst. Due to the unpredictable nature of droplet formation during the bursting of the bubble walls, and the corresponding variation in droplet sizes, the fibres that formed from these droplets had no reproducible diameters or morphologies.

Example 2

Solutions were made of polyvinyl alcohol (PVOH) (Mw=72 000 g/mol, >98% hydrolysed) at different concentrations in distilled water, with different concentrations of the surfactant sodium lauryl sulphate (SLS) as follows:

| Polymer concentration (wt %) | Surfactant concentration (xCMC SLS)* |
|---|---|
| 8 | 0.1 |
| 8 | 0.5 |
| 8 | 1 |
| 10 | 0.1 |
| 10 | 0.5 |
| 10 | 1.0 |
| 12 | 0.1 |
| 12 | 0.5 |
| 12 | 1.0 |

*1xCMC of SLS = 0.0082 mol/l

The apparatus shown in FIG. 1 was used with the distance between the bath (2) and the counter-electrode (6) set to 10 cm. The solution containing the polymer and surfactant was poured into the bath and the airflow was switched on and regulated to obtain a stable foam. A high voltage was applied between the solution in the bath and the counter-electrode and adjusted to a voltage just above the voltage required for jet initiation in the particular solution. This ranged between 25 kV and 35 kV. Multiple electrospinning jets erupted from the surfaces of the bubbles and fibres were rapidly formed.

SEM analysis of the resulting fibre webs clearly show the improvement in quality of the obtained fibres as the surfactant concentration is increased and the bubbles became more stable. In order to perform such analysis the counter-electrode was covered with a sheet of aluminium foil and the fibres formed thereon. A sample of the sheet was subsequently taken and subjected to SEM analysis.

Figure 4A:
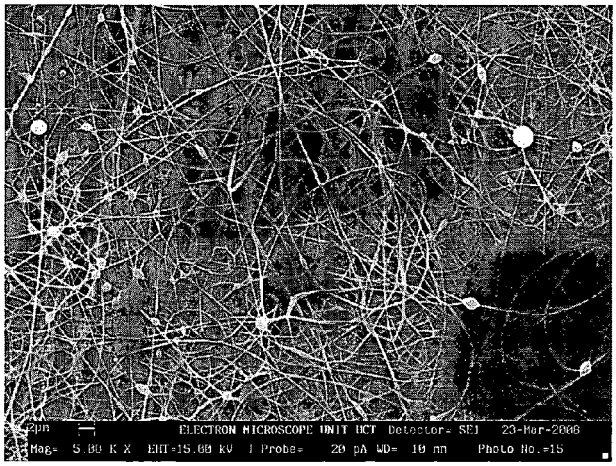
FIGS. 4*a* to 4*c* are SEM images of fibres produced from 8 wt % polyvinyl alcohol solutions with sodium lauryl sulphate as a surfactant at concentrations of 0.1, 0.5 and 1×CMC.
Figure 4B:
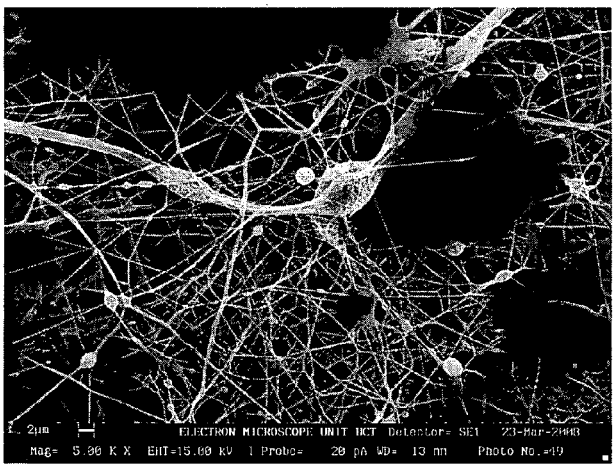
Figure 4C:
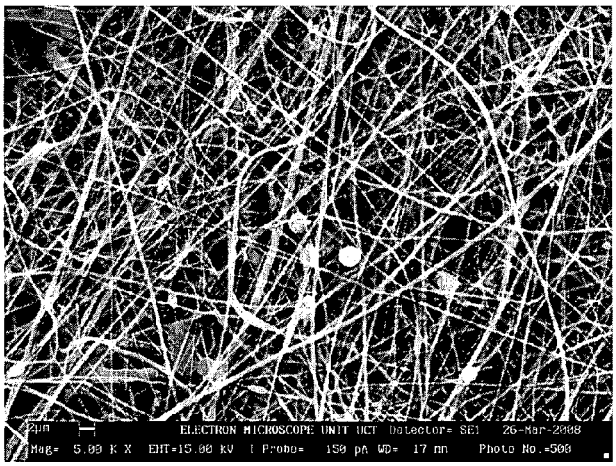

FIGS. 4*a* to 4*c* show the results for the 8 wt % solution. In FIG. 4*a* (with 0.1×CMC surfactant) it is observed that some fibres that formed initially were destroyed by large polymer spatters and that fibres formed later were partially dissolved by solvent vapour. In FIG. 4*b* (with 0.5×CMC surfactant) the fibres are seen to be drier, but large spatters have still destroyed many of the fibres. In FIG. 4*c* (with 1.0×CMC surfactant) a significant improvement is observed with mostly dry fibres and markedly reduced spatters.

Figure 5A:
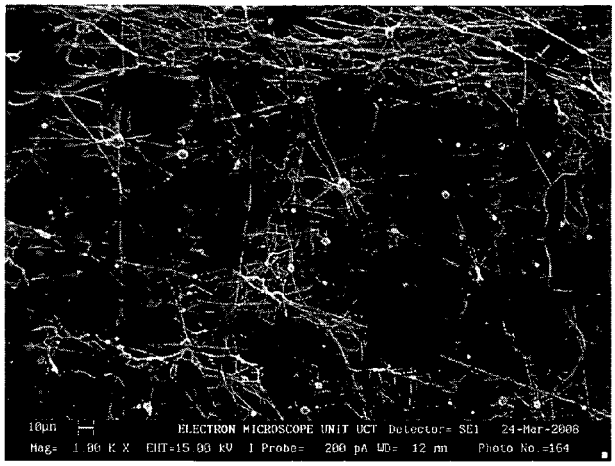
FIGS. 5*a* to 5*c* are SEM images of fibres produced from 10 wt % polyvinyl alcohol solutions with sodium lauryl sulphate as a surfactant at concentrations of 0.1, 0.5 and 1×CMC.
Figure 5B:
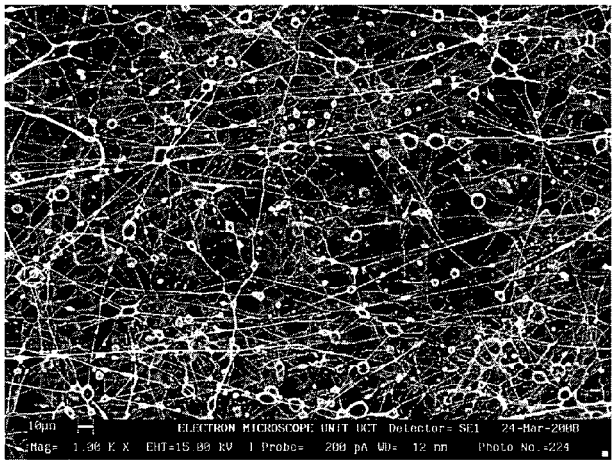
Figure 5C:
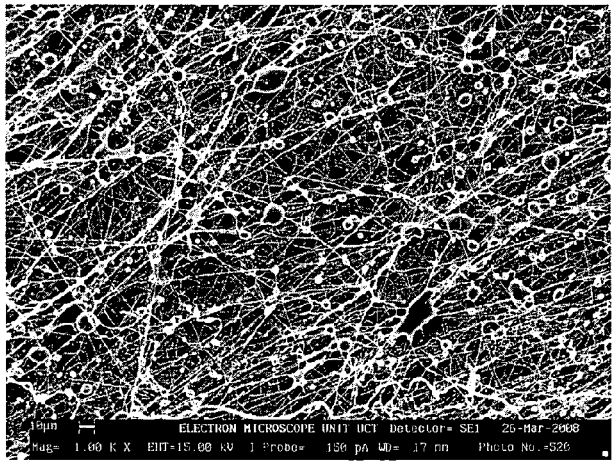

FIGS. 5*a* to 5*c* shows similar results for the 10 wt % solution. In FIG. 5*a* (with 0.1×CMC surfactant) it is observed that most of the fibres were destroyed by large polymer spatters. In FIG. 5*b* (with 0.5×CMC surfactant) the fibres are drier, but many fibres exhibit bead defects and the volume ratio between defects and fibres is high. In FIG. 5*c* (with 1.0×CMC surfactant) an improvement over the results in FIG. 5*b* is observed with mostly dry fibres and an improved volume ratio between bead defects and normal fibres.

Figure 6A:
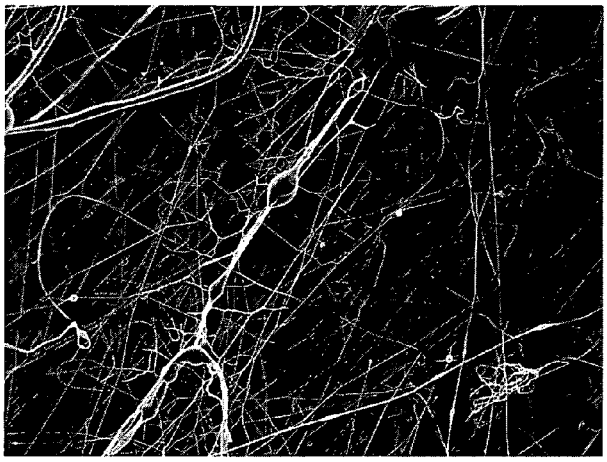
FIGS. 6*a* to 6*c* are SEM images of fibres produced from 12 wt % polyvinyl alcohol solutions with sodium lauryl sulphate as a surfactant at concentrations of 0.1, 0.5 and 1×CMC.
Figure 6B:
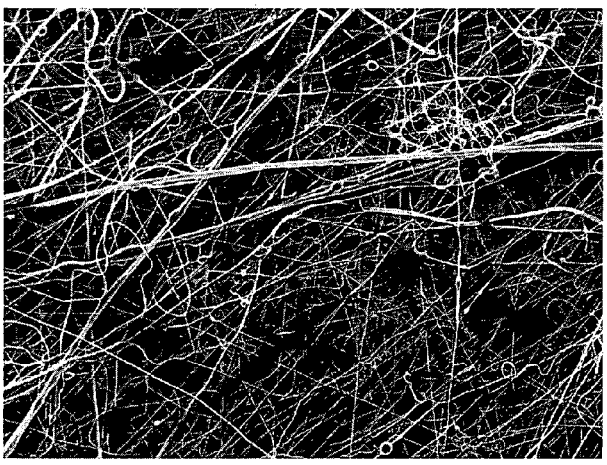
Figure 6C:
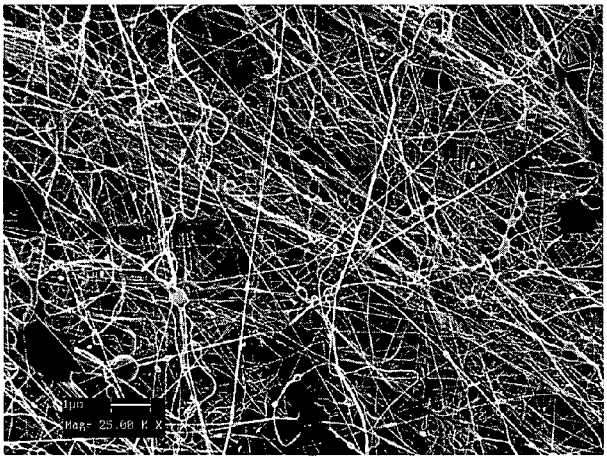

FIGS. 6*a* to 6*c* shows the results for the 12 wt % solution. In FIG. 6*a* (with 0.1×CMC surfactant) dark lines are observed where wet jets deposited on the counter-electrode, destroying underlying fibres. In FIG. 6*b* (with 0.5×CMC surfactant) the ratio of dry fibres is improved but some irregular fibre morphology can still be observed. In FIG. 6*c* (with 1.0×CMC surfactant) a further improvement is observed with mostly dry fibres and increased fibre uniformity.

From these tests it is evident that stabilising the bubbles in the solution has a dramatic effect on fibre quality. Not only is spatter reduced with a concomitant reduction in fibre damage, but fibre quality also improves.

It will be appreciated that many other embodiments of a process for producing fibres exist which fall within the scope of the invention particularly regarding the type of fibre spinning solution and surfactant used, the method of forming bubbles and the conditions under which fibre formation is performed.

The invention claimed is:

1. A process for producing fibres comprising:

forming a plurality of bubbles on the surface of a fiber spinning solution;

positioning a counter-electrode a designated distance from the solution for reducing contact between solution droplets generated by bursting bubbles and spun fibers; and applying a voltage between the solution and a counter-electrode spaced apart therefrom to cause jets to extend from the bubbles to the counter-electrode, and treating the solution with a foam stabilizing surfactant to stabilize the bubbles and enhance bubble lifetime.

2. The process as claimed in claim 1 in which the surfactant is selected from anionic surfactants, cationic surfactants, nonionic surfactants, and zitterionic surfactants for aqueous solutions.

3. The process as claimed in claim 1 in which the surfactant includes a silicone surfactant for organic solutions.

4. The process as claimed in claim 1 in which the surfactant improves bubble formation efficiency.

5. The process as claimed in claim 1 in which the surfactant enhances bubble structure and uniformity.

6. The process as claimed in claim 1 in which the rate of bubble formation in the solution is controlled to maintain the bubbles at a predetermined distance from the counter-electrode.

7. The process as claimed in claim 1 in which the bubbles are formed in a container provided with an overflow trough through which bubbles exceeding a predetermined height are drawn off.

8. The process as claimed in claim 7 in which the volume of the solution in the container is maintained at a predetermined level.

9. The process as claimed in claim 1 in which fibres formed by the jets are continuously drawn off the counter-electrode for further processing.

10. The process as claimed in claim 9 in which the counter-electrode includes a plurality of spaced apart, moving conductors.

11. The process as claimed in claim 1 in which the bubbles are formed by introducing a gas under pressure into the solution.

12. The process as claimed in claim 11 in which the gas is introduced into the solution at a pressure not substantially greater than that required to produce bubbles.

13. The process as claimed in claim 11 in which the rate of introduction of the gas into the solution is controlled to maintain the bubbles at predetermined distance from the counter-electrode.

* * * * *